US009027214B2

(12) United States Patent
Kaulitzki et al.

(10) Patent No.: US 9,027,214 B2
(45) Date of Patent: May 12, 2015

(54) DEVICE FOR PRODUCING INTERLACED KNOTS

(71) Applicant: Oerlikon Textile GmbH & Co. KG, Remscheid (DE)

(72) Inventors: Marco Kaulitzki, Nortorf (DE); Mathias Stündl, Wedel (DE); Claus Matthies, Ehndorf (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 206 days.

(21) Appl. No.: 13/910,541

(22) Filed: Jun. 5, 2013

(65) Prior Publication Data

US 2013/0263414 A1 Oct. 10, 2013

Related U.S. Application Data

(63) Continuation-in-part of application No. PCT/EP2011/067043, filed on Sep. 29, 2011.

(30) Foreign Application Priority Data

Dec. 22, 2010 (DE) ..... 10 2010 055 861

(51) Int. Cl.
*D02J 1/08* (2006.01)
*D02G 1/16* (2006.01)

(52) U.S. Cl.
CPC ..... *D02G 1/161* (2013.01); *D02G 1/162* (2013.01); *D02J 1/08* (2013.01)

(58) Field of Classification Search
CPC ..... D02G 1/161; D02G 1/162; D02G 1/16; D02J 1/08; D02J 1/06; D04G 5/00
USPC ..... 28/571, 252, 272–276, 219, 253; 57/908, 293, 289, 350
See application file for complete search history.

(56) References Cited

U.S. PATENT DOCUMENTS 2,985,995 A * 5/1961 Bunting, Jr. et al. ..... 57/204
3,110,151 A * 11/1963 Bunting, Jr. et al. ..... 57/350

(Continued)

FOREIGN PATENT DOCUMENTS

DE 41 40 469 6/1993
DE 195 01 309 8/1995

(Continued)

OTHER PUBLICATIONS

PCT/EP2011/067043 International Preliminary Report on Patentability dated Jun. 25, 2013 (6 pages).

(Continued)

*Primary Examiner* — Amy Vanatta
(74) *Attorney, Agent, or Firm* — Brinks Gilson & Lione; G. Peter Nichols

(57) ABSTRACT

A device for producing interlaced knots in a multifilament thread is described. The device includes a rotating nozzle ring having a circumferential guide groove and a plurality of nozzle bores opening radially into the base of the guide groove. A stationary pressure chamber, having a chamber opening and an air connection, is associated with the nozzle ring, wherein by rotation of the nozzle ring the nozzle bores can be connected in turn to the chamber opening of the pressure chamber. To permit an intensive air treatment of the thread, the dimension of the chamber opening in the pressure chamber and the spacing of adjacent nozzle bores on the nozzle ring are designed such that as the nozzle ring rotates a plurality of nozzle bores are simultaneously connected to the chamber opening.

13 Claims, 6 Drawing Sheets

(56) References Cited

U.S. PATENT DOCUMENTS

| | | | | | |
|---|---|---|---|---|---|
| 3,363,041 | A | * | 1/1968 | Shichman et al. | 264/282 |
| 3,394,440 | A | * | 7/1968 | Van Holten | 28/275 |
| RE27,717 | E | * | 8/1973 | Breen et al. | 57/283 |
| 3,937,252 | A | * | 2/1976 | Ishida | 137/624.13 |
| 3,952,386 | A | * | 4/1976 | Joly et al. | 28/271 |
| 4,058,960 | A | * | 11/1977 | Movshovich et al. | 57/293 |
| 4,381,181 | A | * | 4/1983 | Clegg | 417/423.7 |
| 4,949,440 | A | * | 8/1990 | Niederer et al. | 28/271 |

FOREIGN PATENT DOCUMENTS

| | | |
|---|---|---|
| GB | 2 321 651 | 8/1998 |
| WO | WO 2008/128863 | 10/2008 |

OTHER PUBLICATIONS

PCT/EP2011/067043 International Search Report dated Dec. 13, 2011 (4 pages including 2 page English translation).

* cited by examiner

DEVICE FOR PRODUCING INTERLACED KNOTS

This application is a continuation-in-part of and claims the benefit of priority from PCT application PCT/EP2011/067043 filed Sep. 29, 2011; and German Patent Application DE 10 2011 055 861.3 filed Dec. 22, 2010, the disclosure of each is hereby incorporated by reference in its entirety.

BACKGROUND

The invention concerns a device for producing interlaced knots in a multifilament thread.

A generic device for producing interlaced knots in a multifilament thread is known from DE 41 40 469 A1. It is generally known that with the production of multifilament threads, the coherence of the individual filament strands in the threads is obtained by means of so-called interlaced knots. Interlaced knots of this type are produced by means of pressurized air treatment of the threads. Depending on the type of threads, and the process, the desired number of interlaced knots for each unit of length as well as the stability of the interlaced knots may be subject to different demands. Particularly with the production of carpet yarns, in which further processing occurs immediately following a melt spinning process, a high degree of knot stability and a relatively high number of interlaced knots for each unit of length of the thread is desired.

In order to obtain, in particular, a high number of interlaced knots at higher thread feed speeds, the generic device includes a rotating nozzle ring, which acts together with a stationary stator. The nozzle ring includes a thread guide groove on its circumference. On the groove base numerous nozzle bores open, which are uniformly distributed over the circumference. The nozzle bores radially penetrate the nozzle ring, from the guide groove to an inner pilot diameter, which follows the circumference of the stator. The stator includes an internal pressure chamber, which is connected by means of a chamber aperture formed on the circumference of the stator. The chamber aperture on the stator, as well as the nozzle bores in the nozzle ring lie in a plane, such that when the nozzle ring is rotated, the nozzle bores are guided successively to the chamber aperture. In this manner, by means of the rotation of the nozzle ring, an air quantity is determined, which is blown from the chamber aperture, via the nozzle bore, into the guide groove, for the purpose of swirling the multifilament threads. As a result, each of the nozzle bores generates a pressure pulse within the guide groove. For this it is necessary that aside from a typical swirling of the filament strands, the quantity of air acting on the threads is sufficient to produce knot-like interlacings, which exhibit sufficient dimensional stability. As such, it has been observed that with smaller air quantities, and accordingly smaller pressure pulses, only swirling is obtained, and no interlaced knots are produced.

SUMMARY

It is therefore an objective of the invention to further develop the generic device for producing interlaced knots in such a manner that the air treatment in the guide groove is intensified, and in order to be able to produce strongly pronounced interlaced knots on the threads.

This objective is attained in accordance with the invention by designing the size of the chamber aperture of the pressure chamber and the spacing of adjacent nozzle bores on the nozzle ring such that with a rotating of the nozzle ring, numerous nozzle bores are simultaneously connected to the chamber aperture.

Advantageous further embodiments of the invention are defined by the features and combinations of features described below.

The invention has the particular advantage that, within the guide groove, numerous simultaneously generated pressurized air pulses act on the thread in order to simultaneously produce numerous interlaced knots. As a result, it is possible to substantially intensify the air treatment, and furthermore, to substantially increase the number of interlaced knots for each unit of length of the thread. In this respect, the device according to the invention is particularly suited for producing a high number of interlaced knots in the range of >20 knots per meter of thread length at thread feed speeds of over 3,000 m/min.

In order to ensure that the threads make contact in the guide groove, the device according to the invention is designed in such a manner that an input thread guide and an output thread guide are provided, which are disposed at each side of the nozzle ring, and which guide the threads into contact in the groove base of the guide groove of the nozzle ring, and that an aperture angle of the chamber aperture and a contact wrap angle of the thread overlap in the guide groove. As a result, the threads are retained directly over the openings of the nozzle bores. The contact of the threads on the groove base of the guide groove limits the mobility of the threads, such that as a result, a vigorous knot formation occurs.

To ensure that the threads are guided into contact at the opening of the nozzle bores, before the pressure pulse is generated, the device according to the invention is designed in such a manner that an angular pitch formed between adjacent nozzle bores is smaller than the contact wrap angle of the threads. As a result, it is ensured that the threads pass over numerous apertures of the nozzle bores.

The input thread guide and the output thread guide are configured such that the contact wrap angle of the threads in the guide groove of the nozzle ring is greater than the aperture angle of the chamber aperture. As a result, it is ensured that the thread already lies in the groove base of the guide groove, prior to the air treatment, such that a high degree of uniformity in the development of the interlaced knots is obtained.

To intensify the air treatment within the guide groove, a movable cover is associated with the nozzle ring in the contact region between the guide groove and the thread, by means of which the guide groove can be covered. As a result, a radial leakage of the air from the guide groove is prevented. The air is guided by the cover in the circumferential direction of the guide groove.

Air losses escaping radially at the sides can be advantageously minimized thereby, because the cover includes a cover surface fitted to the circumference of the nozzle ring, wherein the cover surface of the cover extends at both sides of the guide groove.

To implement more intense pressurized air pulses, the device according to the invention is designed with an annular nozzle ring, which has an inner sliding surface, which acts together with a cylindrical sealing surface of a stator, onto which the chamber aperture opens directly. It is thus possible to design the nozzle bore between the inner sliding surface of the nozzle ring and the guide groove on the circumference of the nozzle ring such that it is very short. Pressurized air flowing from the pressurized air chamber thus arrives directly in the guide groove, without significant pressure losses.

Alternatively, it is possible to design the nozzle ring such that it is in the shape of a disk, having a sliding surface on its front side or surface, in which the nozzle bores open axially. The pressure chamber is formed on a stator disposed to the side of the nozzle ring, which includes a planar sealing surface opposite the front-side sliding surface of the nozzle ring, onto which the chamber aperture opens. The sliding surface of the nozzle ring acts together with the sealing surface of the stator in order to introduce pressurized air into the nozzle bores via the chamber aperture. With this design of the nozzle ring, the nozzle bores each include a radial section and an axial section, preferably having different diameters. The radial section of the nozzle bore, which opens directly onto the groove base of the guide groove, is coordinated to the thread treatment, and normally includes a smaller diameter than the axial section of the nozzle bores, which open onto the front-side sliding surface.

The thread guide inside of the thread guide groove can be improved in order to produce special swirling effects by disposing numerous recesses uniformly on the circumference of the nozzle ring in the groove base of the guide groove, wherein a single recess is disposed between two adjacent nozzle bores. As a result, numerous thread sections are created in the wrap region of the thread, which do not make contact, and are retained such that they are free from contact in the guide groove. Furthermore, the pressurized air flowing from the nozzle bores into the guide groove is collected in the recesses, such that supplementary swirling is generated in the free thread sections. Thus, aside from the interlaced knots, releasable swirls are also formed.

With the device according to the invention, it is possible to power the nozzle ring by means of the incoming threads. However, in order to be able to adjust specific relative speeds between the threads and the nozzle ring, a particularly advantageous further embodiment of the device according to the invention is designed in which the nozzle ring can be driven, and is coupled to an electric motor. As a result, it is possible to drive the nozzle ring either faster or slower in relation to the thread speed of the threads.

The device according to the invention is particularly suited for producing a high number of stable and pronounced interlaced knots on multifilament threads at thread speeds of over 3,000 m/min.

BRIEF DESCRIPTION OF THE DRAWINGS

The device according to the invention shall be explained in greater detail below based on a few embodiments, with reference to the attached figures.

DETAILED DESCRIPTION

Figure 1:
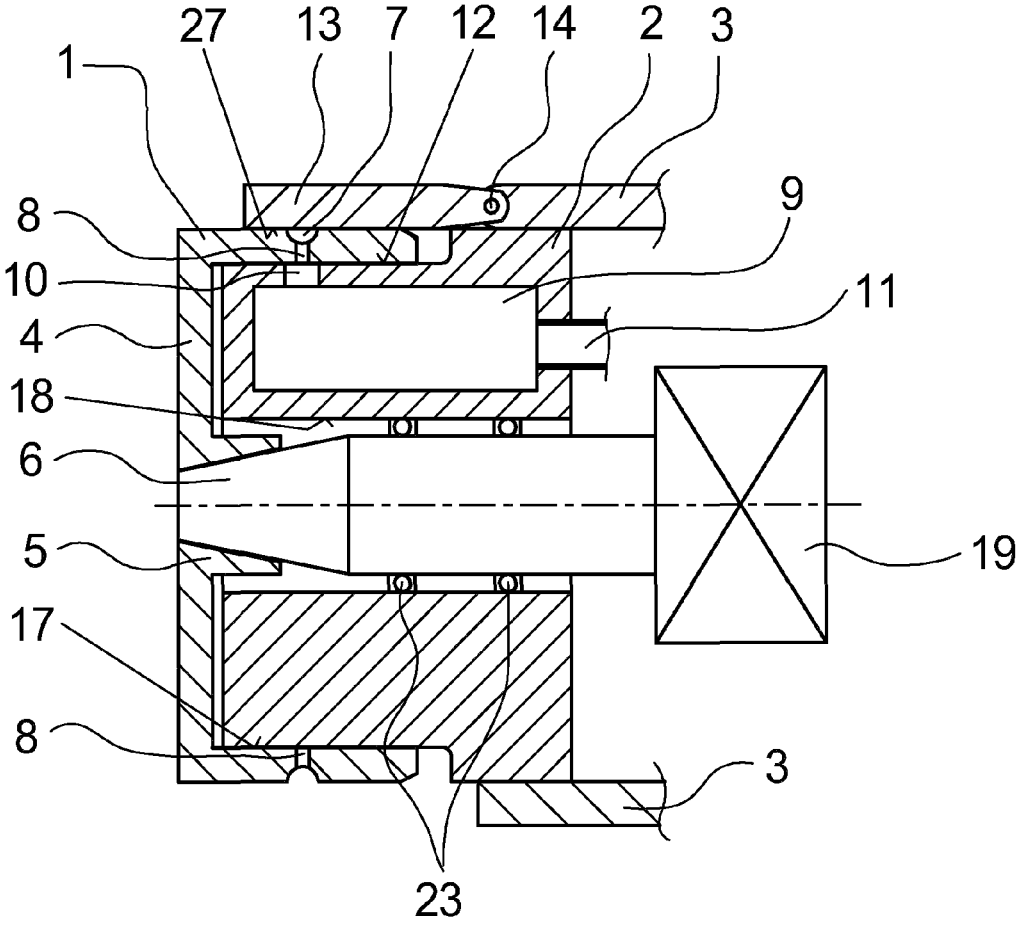
FIG. 1 shows schematically, a longitudinal sectional view of a first embodiment of the device according to the invention.
Figure 2:
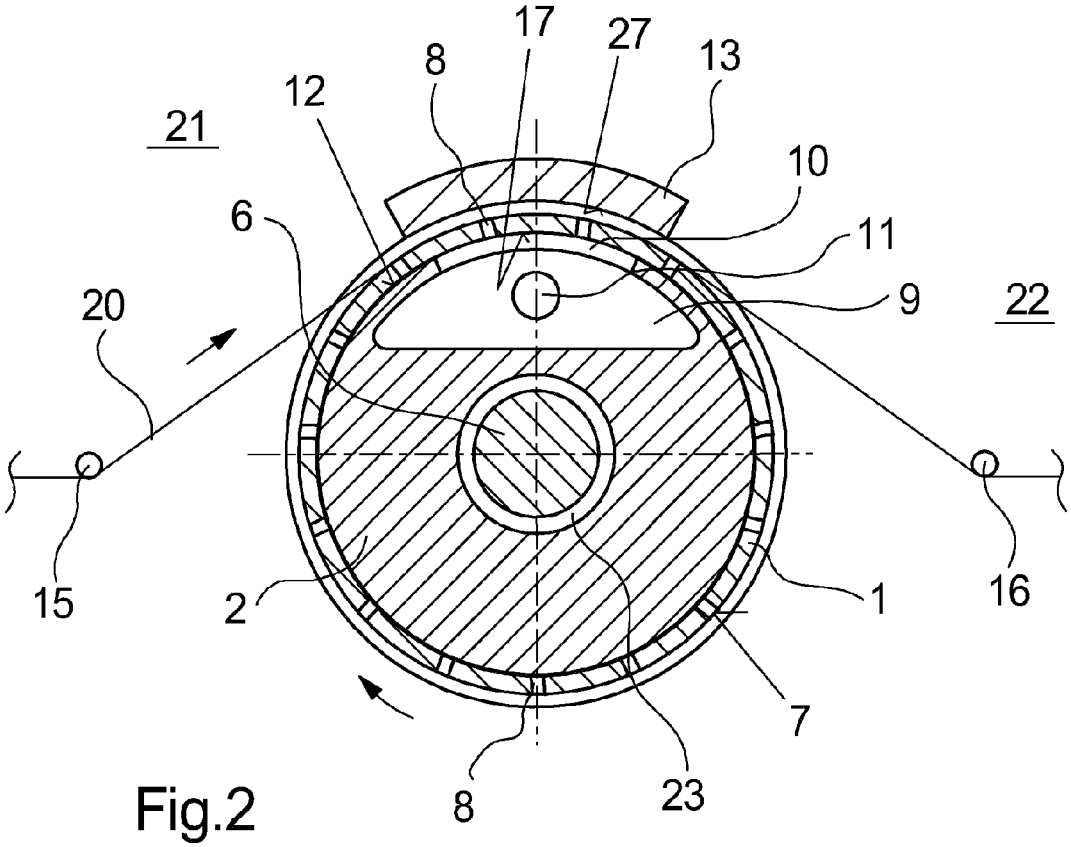
FIG. 2 shows schematically, a cross-section view of the embodiment from FIG. 1.

A first embodiment of the device according to the invention is depicted in FIGS. 1 and 2. FIG. 1 shows the embodiment in a longitudinal sectional view, and in FIG. 2, the embodiment is shown in a cross-section. Insofar as no express reference is made to one of the figures, the following description applies to both figures.

The embodiment of the device according to the invention for the production of interlaced knots in a multifilament thread includes a rotating nozzle ring 1, which has an annular design, and has a circumferential guide groove 7 on its circumference. Numerous nozzle bores 8 open onto the groove base of the guide groove 7, and are distributed uniformly over the circumference of the nozzle ring 1. The nozzle bores 8 penetrate the nozzle ring 1 until they meet an inner sliding surface 17.

The nozzle ring 1 is connected to a drive shaft 6 by means of a front wall 4 and a hub 5 disposed centrally on the front wall 4. The hub 5 is fastened to a free end of the drive shaft 6 for this purpose.

The cylindrical inner sliding surface 17 of the nozzle ring 1 is guided in the shape of a sleeve onto a guide section of a stator 2 and forms a cylindrical sealing surface 12 lying opposite the sliding surface 17. The stator 2 includes a chamber aperture 10 on the circumference of the cylindrical sealing surface 12 at a position where it is connected to a pressure chamber 9 formed in the interior of the stator 2. The pressure chamber 9 is connected to a pressure source, not shown here, by means of a pressurized air connection 11. The chamber aperture 10 in the cylindrical sealing surface 12, and the nozzle bores 8 on the inner sliding surface 17 of the nozzle ring 1, are in a plane, such that, by rotating the nozzle ring 1, the nozzle bores 8 are guided into the region of the chamber aperture 10. The chamber aperture 10 is designed for this purpose as an elongated hole, and extends radially over a longer guide region of the nozzle bores 8. The size of the chamber aperture 10 thus determines an opening time of the nozzle bores 8, during which said bores 8 generate a pressure pulse.

With the embodiment depicted in FIGS. 1 and 2, the size of the chamber aperture 10 and the cylindrical sealing surface 12 of the stator are dimensioned such that numerous nozzle bores 8 of the nozzle ring 1 are simultaneously connected to the chamber aperture 10. In this embodiment, in each case two nozzle bores 8 are simultaneously connected to the chamber aperture 10. In this respect, the chamber aperture 10 is greater in the radial direction than a spacing on the nozzle ring 1 formed between adjacent nozzle bores 8.

The stator 2 is mounted on a base 3, and includes a medium sized bearing bore 18, which is designed to be concentric to the cylindrical sealing surface 12. The drive shaft 6 is rotatably supported by means of the bearing 23 inside of the bearing bore 18.

The drive shaft 6 is coupled at one end to an electric motor 19, by means of which the nozzle ring 1 can be powered at predetermined circumferential speeds. The electric motor 19 is disposed for this purpose on the side of the stator 2.

As can be seen from FIG. 1, a cover 13 is associated with the nozzle ring 1 on its circumference and is retained via a pivotal axis 14 on the base 3 such that it can move.

As can be seen from FIG. 2, the cover 13 extends radially over the circumference of the nozzle ring 1, over an area which includes the stator 2 inside of the chamber aperture 10. The cover 13 includes a fitted cover surface 27 on the surface facing the nozzle ring 1 and entirely covers the guide groove 7. A thread 20 is guided in this region into the guide groove 7 on the circumference of the nozzle ring 1. For this, an input thread guide 15 is associated with the input end 21 of the nozzle ring 1, and an output thread guide 16 is associated with an output end 22. The thread 20 can thus be guided with a partial wrap about the nozzle ring 1, between the input thread guide 15 and the output thread guide 16.

With the embodiment depicted in FIGS. 1 and 2, pressurized air is introduced into the pressure chamber 9 of the stator 2 for the production of interlaced knots in the multifilament thread 20. The nozzle ring 1, which guides the thread 20 into the guide groove 7, generates continuous pressurized air pulses as soon as the nozzle bores 8 are in the region of the chamber aperture 10. At this point the pressure pulses lead to localized swirls in the multifilament thread 20, such that numerous interlaced knots form on the thread.

To produce uniform and intensively formed interlaced knots on the thread, the thread 20 is guided with a contact wrap angle in the groove base of the guide groove 7. For this purpose, the input thread guide 15 and the output thread guide 16 are designed such that the contact wrap angle of the thread in the guide groove of the nozzle ring includes a minimum wrap angle in relation to the chamber aperture 10.

Figure 3:
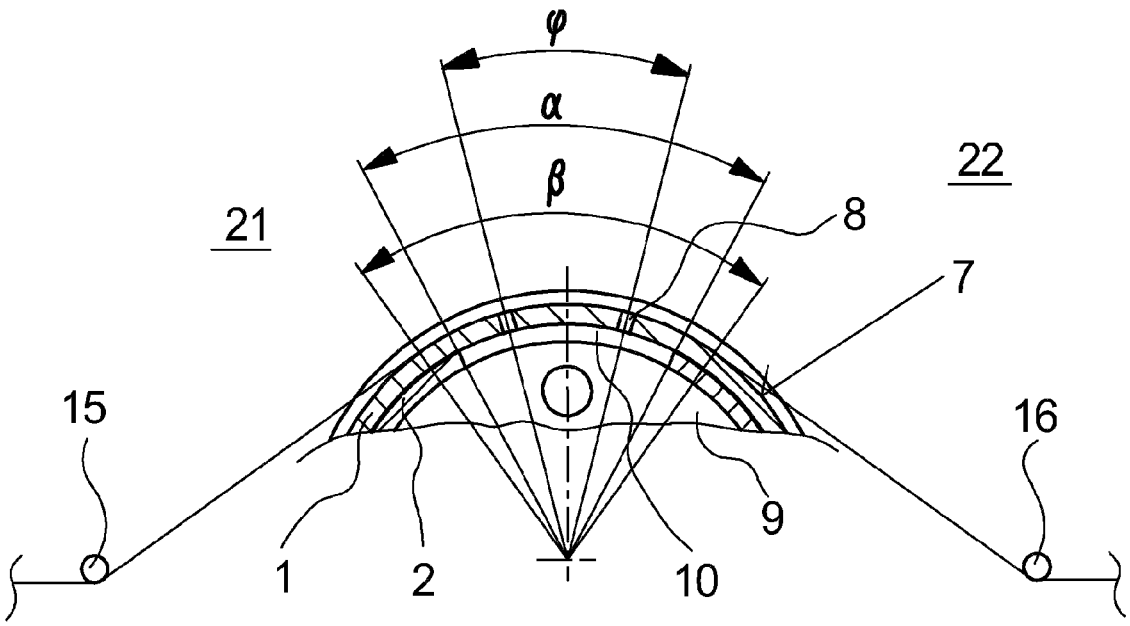
FIG. 3 shows schematically, a simplified cross-section view of the embodiment from FIG. 1.

The geometric dimensions and relationships of the embodiment from FIGS. 1 and 2 are depicted in greater detail in FIG. 3. In this case, the input thread guide 15 and the output thread guide 16 are disposed such that they are mirror-symmetrical in relation to the nozzle ring 1, such that a mirror-symmetrical axis is formed between the input thread guide 15 and the output thread guide 16. In this embodiment, the mirror-symmetrical axis is identical to a center of the chamber aperture 10 on the circumference of the stator 2. The chamber aperture 10 extends radially over an aperture angle $\alpha$.

The nozzle bores 8 corresponding to the chamber aperture 10 are disposed uniformly on the circumference, such that the spacing between two adjacent nozzle bores 8 is defined by an angular pitch $\phi$.

The contact length of the thread 20 in the groove base of the guide groove 7 of the nozzle ring 1 can be defined by a contact wrap angle $\beta$. The contact wrap angle $\beta$ of the thread guide, the angular pitch $\phi$ of the nozzle bores 8, and the aperture angle $\alpha$ of the chamber aperture 10 are depicted in FIG. 3. For this, the angles of the device according to the invention are in the following relationships to one another.

First, it is assumed that the angular pitch $\phi$ of the nozzle bores 8 is always smaller than the aperture angle $\alpha$ of the chamber aperture 10. As a result, numerous nozzle bores 8 are simultaneously in connection with the chamber aperture 10. Furthermore, the angular pitch $\phi$ of the nozzle bores 8 is smaller than the contact wrap angle $\beta$ of the thread 20. As a result, it is ensured that the thread 20 is guided, during the air treatment, directly over the opening region of the nozzle bores 8 in the groove base of the guide groove 7. It is furthermore provided that the contact wrap angle $\beta$ is greater than the aperture angle $\alpha$ of the chamber aperture 10 on the circumference of the stator 2. The thread 20 is thus guided with an ensured contact on the groove base of the guide groove 7 already before being subjected to a pressure pulse. The mobility of the thread 20 between the input thread guide 15 and the output thread guide 16 is thus limited by the guidance of the guide groove 7, which has led, in particular, to an increase in the knot stability.

Figure 4:
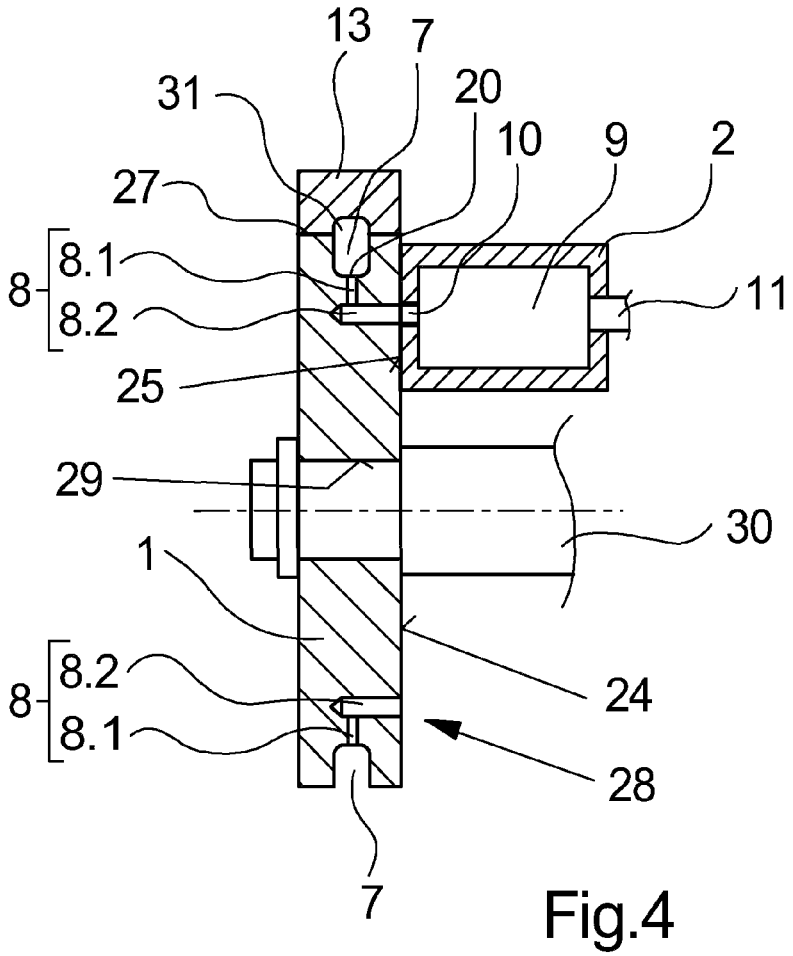
FIG. 4 shows schematically, a longitudinal sectional view of another embodiment of the device according to the invention.
Figure 5:
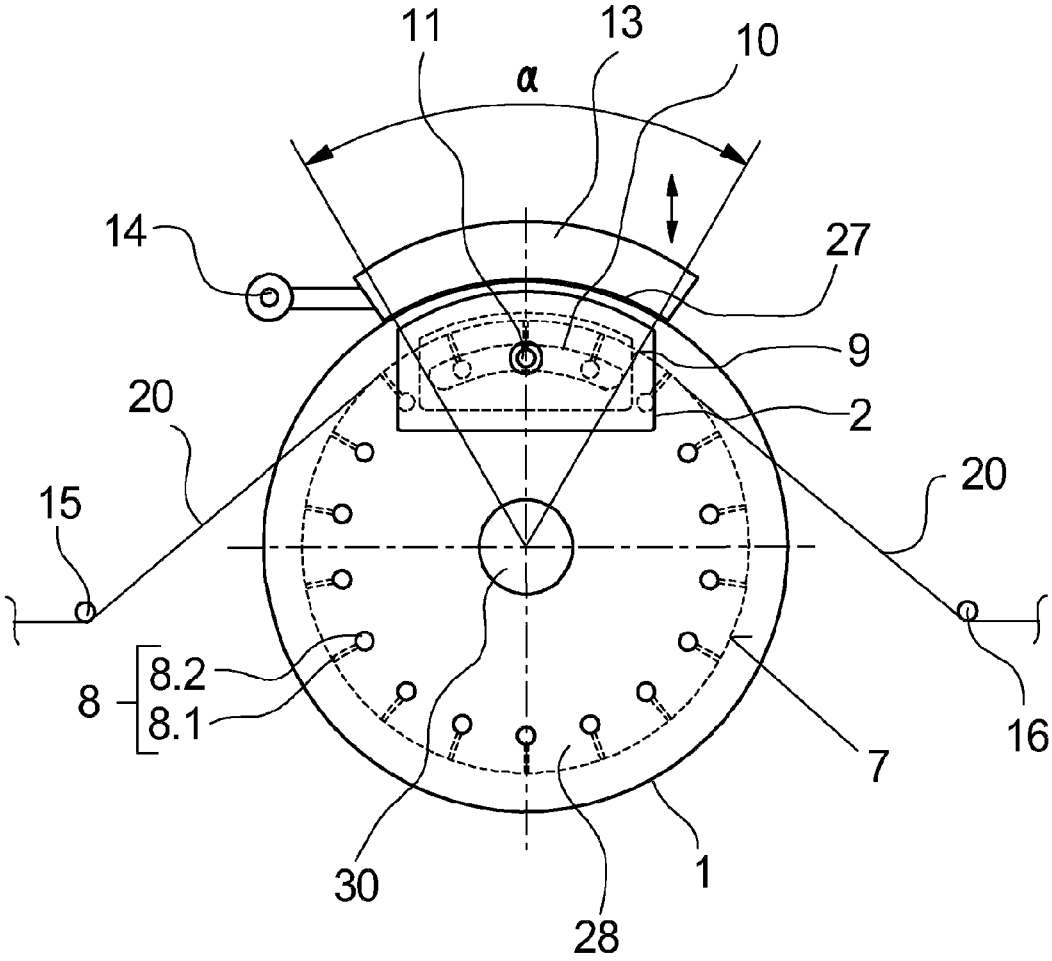
FIG. 5 shows schematically, a side view of the embodiment from FIG. 4.

Another embodiment of the device according to the invention is depicted in FIGS. 4 and 5. A longitudinal sectional view is shown schematically in FIG. 4, and a side view is shown schematically in FIG. 5. Insofar as no express reference is made to one of the figures, the following description applies to both figures.

With the embodiment of the device according to the invention for producing interlaced knots in a multifilament thread depicted in FIGS. 4 and 5, a nozzle ring 1 is designed in the shape of a disk. The nozzle ring 1 has a guide groove 7 on its outer circumference, which radially spans the nozzle ring 1. Numerous nozzle bores 8 open onto the groove base of the guide groove 7. The nozzle bores 8 formed in the nozzle ring 1 each include two nozzle bore sections 8.1 and 8.2. The nozzle bore section 8.1 has a radial orientation, and opens onto the groove base of the guide groove 7. The nozzle bore section 8.2 has an axial orientation, and opens onto a front surface 28 of the nozzle ring 1. The nozzle bore section 8.2 is designed as a blind bore, and is shaped in terms of its length such that the two nozzle bore sections 8.1 and 8.2 are connected to one another. The nozzle bore section 8.2 is preferably designed such that it has a substantially larger diameter, in order to supply pressurized air to the nozzle bore section 8.1. The nozzle bore section 8.1 serves to generate a pressurized air flow, which flows into the guide groove 7 for the treatment of the thread.

The nozzle ring 1 is connected via a central retaining bore 29 to a bearing pin 30. The bearing pin 30 is rotatably supported in a machine frame, not shown here, such that the nozzle ring 1 can freely rotate.

A sliding surface 24 is formed on the front surface 28 of the nozzle ring 1 onto which the nozzle bore sections 8.2 open. A stationary stator 2 is retained in an upper region of the nozzle ring 1 and is retained with a planar sealing surface 25 over a sealing gap on the front surface sliding surface 24 of the nozzle ring 1. A pressure chamber 9 is formed within the stator 2 and is coupled to a pressurized air source, not shown here, via a pressurized air connection 11. A chamber aperture 10 is formed on the planar sealing surface 25 of the stator 2 and forms an outlet for the pressure chamber 9.

As can be seen, in particular, from the depiction in FIG. 5, the chamber aperture 10 extends over an aperture angle $\alpha$ and comprises numerous nozzle bores 8 in the nozzle ring 1. In this respect, numerous nozzle bores 8 are then simultaneously connected to the pressure chamber 9.

A movable cover 13 above the stator 2 is associated with the nozzle ring 1 and can be moved back and forth via a pivotal axis 14 between a closed setting and an open setting, not shown here. The cover 13 includes a cover surface 27, which extends both radially as well as axially over a partial region of the guide groove 7. A corresponding relief groove 31 is formed within the cover 13 opposite the guide groove 7 and forms, together with the guide groove 7, a swirling chamber.

As is depicted in FIG. 5, an input thread guide 15 and an output thread guide 16 for guiding a thread 20 are likewise associated with the nozzle ring 1. For this, a contact wrap region of the thread is defined on the circumference of the nozzle ring, which is greater than the aperture angle of the chamber aperture 10.

The operation for producing interlacing knots in the embodiment depicted in FIGS. 4 and 5 is identical to the embodiment according to FIGS. 1 and 2, such that at this point no further explanations shall be provided in the following. In differing with the aforementioned embodiments, the nozzle ring 1 in this case is driven solely by means of the thread 20. It is, however, also possible that the bearing pin 30 itself forms the drive end of a drive shaft.

Figure 6:
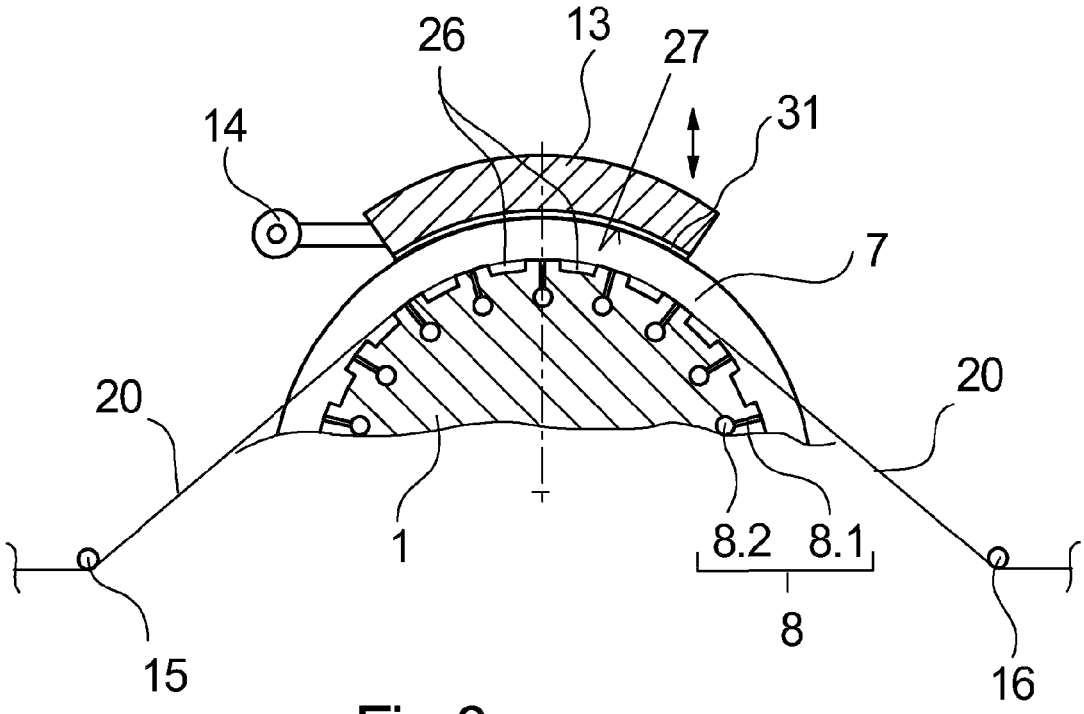
FIG. 6 shows schematically, a cross-section view of another embodiment of the device according to the invention.

Another design of a nozzle ring 1 is shown in FIG. 6, as it could be implemented, for example, in the embodiments according to FIG. 2 or FIG. 5. In FIG. 6, the embodiment of the nozzle ring is shown in a cross-section view. The nozzle ring 1 is identical to the nozzle ring described in FIGS. 4 and 5, such that at this point only the differences shall be explained.

With the nozzle ring depicted in FIG. 6, numerous recesses 26 are formed in the guide groove 7. The recesses 26 are distributed uniformly on the circumference of the nozzle ring 1, wherein one of the recesses 26 is disposed between each pair of adjacent nozzle bores 8. The guide groove 7 thus includes, in an alternating manner, a contact region and a non-contact region for guiding the thread 20. The thread 20 can thus be guided over numerous supporting areas within the contact wrap region on the circumference of the nozzle ring 1. As a result, additional swirling effects can be generated.

REFERENCE SYMBOL LIST

1 nozzle ring
2 stator
3 base
4 front wall
5 hub
6 drive shaft
7 guide groove
8 nozzle bore
8.1, 8.2 nozzle bore section
9 pressure chamber
10 chamber aperture
11 pressurized air connection
12 cylindrical sealing surface
13 cover
14 pivotal axis
15 input thread guide
16 output thread guide
17 inner sliding surface
18 bearing bore
19 electric motor
20 thread
21 input end
22 output end
23 bearing
24 front surface sliding surface
25 planar sealing surface
26 recess
27 cover surface
28 front surface
29 retaining bore
30 bearing pin
31 relief groove

The invention claimed is:

1. A device for producing interlaced knots in a multifilament thread comprising:

a. a nozzle ring, which includes a circumferential guide groove and a plurality of spaced apart nozzle bores opening radially onto a groove base of the guide groove;

b. a stationary pressure chamber associated with the nozzle ring and including an air connection; and, c. a chamber aperture that extends radially over the stationary pressure chamber an amount defined by an aperture angle ($\alpha$), wherein the chamber aperture and the nozzle bores are configured such that, upon rotation of the nozzle ring, at least two nozzle bores are simultaneously fluidly connected with the chamber aperture.

2. The device according to claim 1 further comprising an input thread guide on a first side of the nozzle ring and an output thread guide on a second side of the nozzle ring, wherein the input thread guide and the output thread guide are configured to guide the thread into contact with the groove base of the guide groove of the nozzle ring such that a contact length of the thread in the groove base defines a contact wrap angle ($\beta$).

3. The device according to claim 2, wherein the aperture angle ($\alpha$) and the contact wrap angle ($\beta$) overlap one another.

4. The device according to claim 2, wherein a space between adjacent nozzle bores defines an angular pitch ($\phi$) and wherein the angular pitch ($\phi$) is smaller than the contact wrap angle ($\beta$).

5. The device according to claim 3, wherein a space between adjacent nozzle bores defines an angular pitch ($\phi$) and wherein the angular pitch ($\phi$) is smaller than the contact wrap angle ($\beta$).

6. The device according to claim 3, wherein the input thread guide and the output thread guide are configured such that the contact wrap angle ($\beta$) is greater than the aperture angle ($\alpha$).

7. The device according to claim 5, wherein the input thread guide and the output thread guide are configured such that the contact wrap angle ($\beta$) is greater than the aperture angle ($\alpha$).

8. The device according to claim 1, further comprising a movable cover associated with the nozzle ring in a region where the thread contacts the guide groove such that the guide groove can be covered.

9. The device according to claim 8, wherein the cover includes a cover surface having a shape complementary to the nozzle ring and extending at both sides of the guide groove.

10. The device according to claim 1, wherein the nozzle ring has an annular design with an inner sliding surface, onto which the nozzle bores open radially, the pressure chamber is formed on a stator with a cylindrical sealing surface, onto which the chamber aperture opens, and the sliding surface of the nozzle ring acts together with the sealing surface of the stator for conveying air.

11. The device according to claim 1, wherein the nozzle ring is designed in the shape of a disk with a front surface sliding surface, onto which the nozzle bores open axially, the pressure chamber is formed on a stator with a planar sealing surface, onto which the chamber aperture opens, and the sliding surface of the nozzle ring acts together with the sealing surface of the stator for conveying air.

12. The device according to claim 1, wherein the guide groove includes a plurality of recesses distributed uniformly on the circumference in the groove base, wherein each one of the recesses is disposed between two adjacent nozzle bores.

13. The device according to claim 1, wherein the nozzle ring is designed such that it can be powered, and is coupled to an electric motor.

* * * * *